US006074340A

United States Patent [19]

Sweeney et al.

[11] Patent Number: 6,074,340

[45] Date of Patent: Jun. 13, 2000

[54] INCUBATOR MATTRESS TRAY WITH WARMING FUNCTION

[76] Inventors: Stephen J. Sweeney, 617 Lynn Way, Sykesville, Md. 21784; Thomas C. Jones, 5329 Lighting View Rd., Columbia, Md. 21045

[21] Appl. No.: 09/012,303

[22] Filed: Jan. 23, 1998

[51] Int. Cl.[7] ..... A61G 11/00

[52] U.S. Cl. ..... 600/22; 236/2

[58] Field of Search ..... 600/22, 21; 236/3, 236/9 R, 9 A, 91 F, 2

[56] References Cited

U.S. PATENT DOCUMENTS 4,773,392 9/1988 Koch ..... 600/22
4,885,918 12/1989 Vaccaro ..... 600/22
4,936,824 6/1990 Koch et al. ..... 600/22
5,797,833 8/1998 Kobayashi et al. ..... 600/22
5,853,361 12/1998 Kobayashi et al. ..... 600/22

*Primary Examiner*—Cary O'Connor
*Assistant Examiner*—Navin Natnithithadha
*Attorney, Agent, or Firm*—Roger M. Rathbun

[57] ABSTRACT

An incubator having a mattress tray that underlies and supports an infant. The mattress tray is movable from a first position where it is entirely within the controlled atmosphere of the infant compartment to a second position outside that infant compartment and when moved to the second position, a warm flow of air is provided to warm the infant . The outside position of the mattress thereby allows considerable access to the infant to carry out procedures by attending personnel that would not be possible within the confined infant compartment and yet the invent is warmed by the flow of warm air.

10 Claims, 4 Drawing Sheets

INCUBATOR MATTRESS TRAY WITH WARMING FUNCTION

BACKGROUND

This invention relates to the field of infant incubators and, specifically, to an improved infant incubator having a unique mattress tray design that allows the infant to be removed from the controlled environment of the infant compartment to more fully access the infant and yet maintain a heating function for that infant.

In general, infant incubators are used to provide a protective, controlled environment for infants where the infant is in need of such environment. The environment is heated and includes controlled humidity conditions. It is, of course, important that the infant be maintained in that controlled atmosphere for the well being of the infant. In such incubators, various access doors are provided to gain physical access to the infant to carry out certain procedures on that infant and such access may be by the way of handholes such as disclosed in U.S. Pat. No. 4,773,392 of Koch et al or a more complete access may be occasioned by the opening of a larger door where more access is needed to the infant.

There are times, however, that the need to carry out a procedure on the infant requires more access to that infant than can be carried out with the infant still within the infant incubator, that is, where the use of handholes or even opening the door is not sufficient for the attending personnel to carry out the procedure. At such times, the infant needs to be removed from the protective atmosphere of the infant incubator and remain outside that environment for the period of time the particular procedure is carried out on the infant. Obviously, the removal of an infant from that protective environment is disadvantageous to the infant since the needed heating may not be available to the infant. Other types of heating can be used, such as by use of a radiant warmer, however, that is not always possible and it is more convenient to be able to carry out the procedure on the infant without moving that infant to another location and causing additional disruption.

Accordingly, it would be advantageous to be able to move the infant from the protective environment of the infant incubator to carry out such needed operations while keeping the infant in the locale of that incubator and yet provide some localized heating to the infant during the periods of time that it is outside the incubator environment.

SUMMARY OF THE INVENTION

The present invention provides an improved incubator having a means to allow considerable access to the infant by allowing the infant to be moved from the protective environment of the infant incubator and yet be able to keep the infant near the incubator when the procedure is taking place. Additionally, when the infant is removed from the infant incubator, there is provided an automatic supplemental heat to the infant while outside the protective environment of the incubator. In carrying out the present invention, the infant tray, on which the infant lies, can be moved to a position that is outside the internal environment of the incubator for more access to the infant. In moving that mattress tray, however, the present invention takes advantage of the presence of a stream of warm air that is already being provided to the infant compartment of the infant incubator and to divert some or all of that stream of warm air to provide heat to the infant when in the external position.

Thus, the infant can be removed from the environment and a further stream of heated air provides heat to the infant while it is outside the controlled atmosphere of the infant incubator so that the attending personnel can carry out the desired functions on the infant without greatly compromising the heat loss of that infant.

In the preferred embodiment, the heated stream of air normally used in heating the internal environment of the incubator is diverted to pass through or over the mattress tray so that no additional heating means is necessary to continue the heating of the infant while outside the incubator. Thus, the heating means is relatively easy to achieve and can be automatically provided without any additional functions or operations of the normal incubator heating apparatus.

Other features of the incubator will become more apparent in light of the following detailed description of a preferred embodiment thereof and as illustrated in the accompanying drawings.

DETAILED DESCRIPTION OF THE INVENTION

Figure 1:
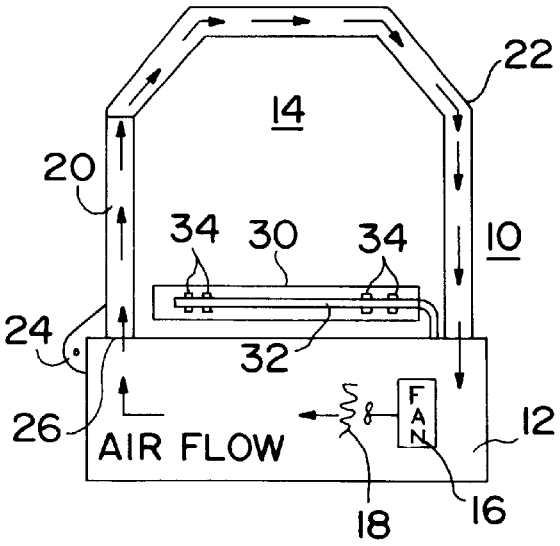
FIG. 1 is a side schematic view of an incubator having incorporated therein, the present invention.
Figure 2:
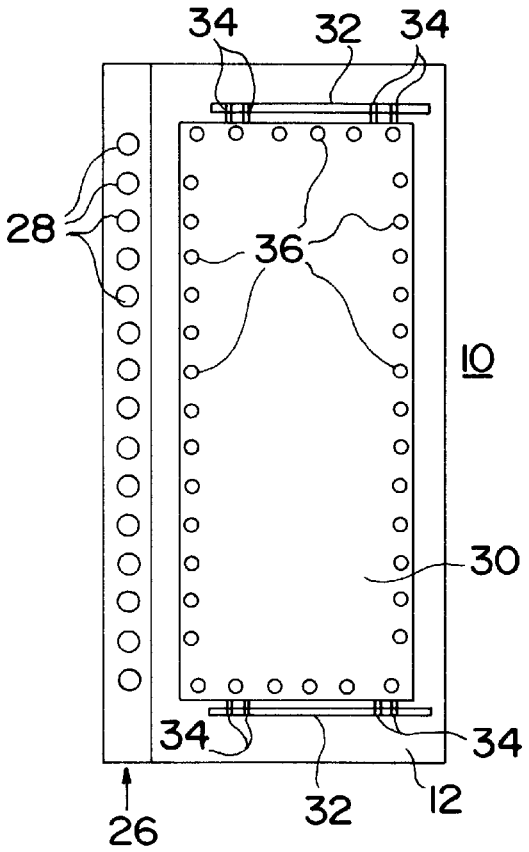
FIG. 2 is a top schematic view of the incubator of FIG. 1.

Referring now to FIGS. 1 and 2, there is shown a side schematic view and a top schematic view of an incubator 10 that is constructed in accordance with the present invention. As shown in FIG. 1, and as will be described herein for convenience, the incubator 10 is similar to that disclosed in U.S. Pat. No. 4,936,824 of Koch et al and which is a typical incubator that may be usable with this invention, however, it will be noted that the present invention can be carried out with various other types and designs of incubators.

Accordingly, there is a base section 12 that contains the various heating and ducting equipment that is used to provide the heating for the infant compartment 14 where an infant is positioned. As shown schematically, that heating and ducting equipment is preferably of conventional design and comprises a fan 16 and a heater 18 such that the heated flow of air is warmed by the heater 18 and which is then passed through a double walled door 20 and through a double walled hood 22 where it returns to the base section 12 for recirculation. As noted in the aforedescribed U.S. Patent, the door 20 and the hood 22 are of a transparent materials so that visual access is maintained with any occupant of the infant compartment 14.

The door 20 is affixed to the base section 12 by means of an hinge 24 that allows the door 20 to be swung out of the way when it is in the open position as will be later explained. As can also be seen, the warm air from the base section 12 passes through an air inlet 26 and which directs the warm air directly into the double wall door 20 as previously explained. In the preferred embodiment, the air inlet comprises a plurality of inlet openings 28, however, an elongated slot could be used as well as other configurations of openings.

A mattress tray 30 is shown and which is used as a base on which the infant rests when contained within the incubator 10. The mattress tray 30 is shown as a flat planar tray that may have a further mattress on the mattress tray 30 for comfort of the infant and which is readily removable for cleaning and the like. Mattress tray 30 is supported so as to be movable with respect to the incubator 10 and one means of allowing such movement is shown in FIG. 1 as support rods 32 that are movably affixed to the base section 12 and affixed to the mattress tray 30 by means of clamps 34 that allow the mattress tray 30 to move with respect to the support rods 32. The mattress tray 30, as shown in FIGS. 1 and 2, is in its first position, that is, it is fully enclosed within the infant compartment 14 and with the door 20, preferably, in the closed position. As such, the normal use of the incubator 10 can be carried out. The infant is within the protective, controlled environment of the infant compartment 14 and yet can be attended to by personnel opening the door 20 and reaching into the infant compartment 14 to carry out various functions on the infant.

As also can be seen in the FIG. 2, there are warm air openings 36 in the mattress tray 30 and which serve as outlets for warm air as will be later explained.

Figure 3:
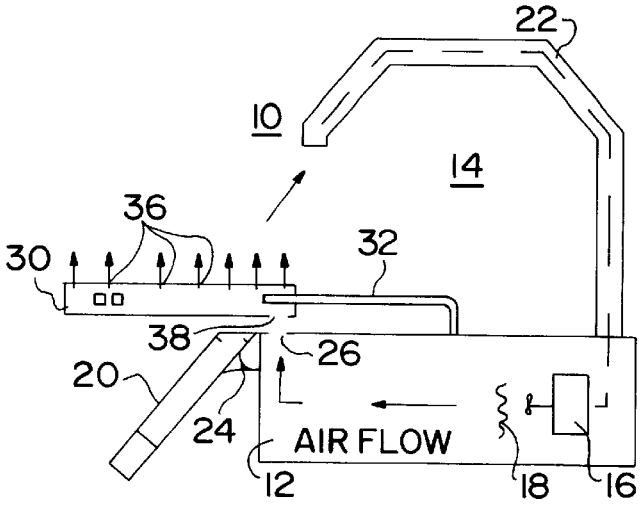
FIG. 3 is a side schematic view of the incubator of FIG. 1 having the mattress tray moved to the position outside the infant compartment of the incubator of FIG. 1.
Figure 4:
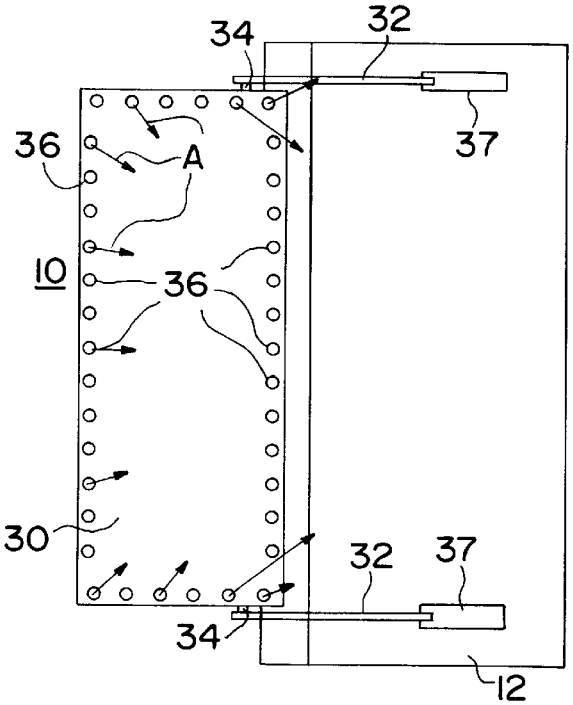
FIG. 4 is a top schematic view of the incubator of FIG. 3 with the mattress tray in the outside position.

Turning now to FIGS. 3 and 4, there is shown a side schematic view and a top schematic view of the incubator of FIGS. 1 and 2 but having the mattress tray 30 in its second position where the mattress tray 30 is moved to a position outside the infant compartment 14. It is noted that the mattress tray 30 need not be completely outside the infant compartment but may only be partially withdrawn in carrying out the present invention, however, it is preferred that it be substantially removed from the infant compartment or even totally removed from the infant compartment 14.

In the position of FIGS. 3 and 4, total access is afforded to an infant resting on the mattress tray 30 so that the hospital personnel may carry out more involved procedures on the infant and can have the access to three sides of the an infant resting on the mattress tray 30. As also can be seen in FIG. 4, a pair of slots 37 may be provided in the base section so that the support rods 32 can be extended to allow the full removal of the mattress tray 30 from the infant compartment 14, it being obvious, however, that there are numerous other conventional mechanisms that can be used to allow the removal of the mattress tray 30 while maintaining a connection to the base section 12 and which can thereafter be returned readily to the fully enclosed position shown in FIGS. 1 and 2.

Figure 5:
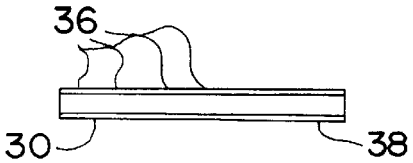
FIG. 5 is a side schematic view of a mattress tray that is usable in carrying out the present invention.

In the open or second position of the mattress tray 30, it can be seen that the air inlet 26 automatically aligns with a mattress tray inlet 38 in mattress tray 30 such that the warm air from the base section 12 travels into the mattress tray 30. Turning briefly to FIG. 5, taken along with FIGS. 3 and 4, there is a side sectional view of the mattress tray 30 and showing the mattress tray inlet 38 where the warm air enters the hollow mattress tray 30 and passes through the mattress tray 30 to emerge through the warm air outlets 36 and thus provide heat to an infant positioned on the mattress tray 30 even when the mattress tray 30 is located in a position completely outside the infant compartment 14. The direction of the air flow is shown by the arrows A and the warm air from the base section 12 moves through the air inlet 26 and immediately enters the mattress tray inlet 38 where it is dispersed around the interior of the mattress and then emerges as a flow of warm air via the warm air outlets 36 located, preferably, around the periphery of the mattress tray 30 to warm an infant.

Figure 6:
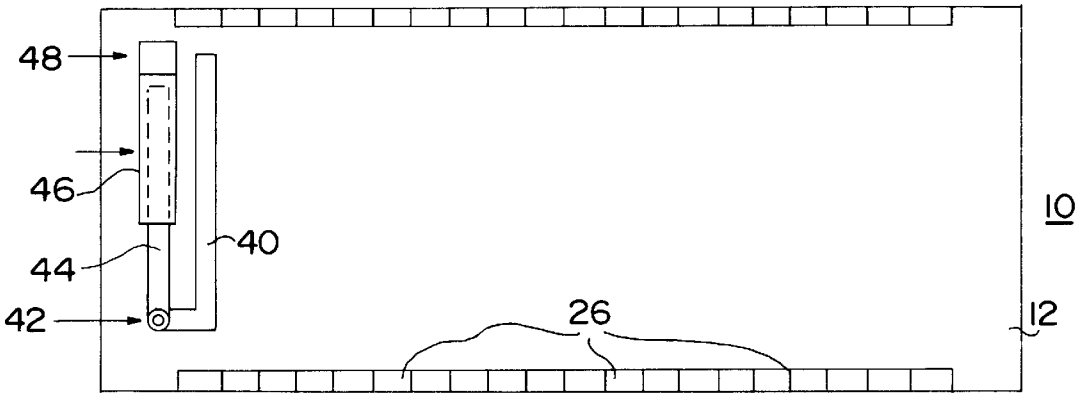
FIG. 6 a top schematic view of an alternate embodiment of the present invention with a rotating mattress tray in its enclosed position within the infant compartment.

Turning now to FIG. 6, there is shown a schematic view of a further embodiment of an incubator 10 adapted to carry out the present invention. In FIG. 6, therefore, the incubator 10 comprises the mattress tray 30 (FIG. 7) mounted to a support arm 40 and which is, in turn, pivotally mounted at pivot point 42 to a telescoping arm 44 that is slidably mounted within a larger diameter receiver cylinder 46. Thus, telescoping arm 44 can be withdrawn from its position within receiver cylinder 46 to extend or replaced by sliding back into the receiver cylinder 46. The receiver cylinder 46 is affixed to the base section 12 at pivot anchor 48. The incubator 10 of FIG. 6 additionally has the base section 12 containing the heating and ducting equipment to provide the flow of warm air up through the air inlet 26 as described with respect to the FIG. 1–5 embodiment and the hood and door of the prior embodiment is applicable to the FIG. 6–9 embodiment.

Figure 7:
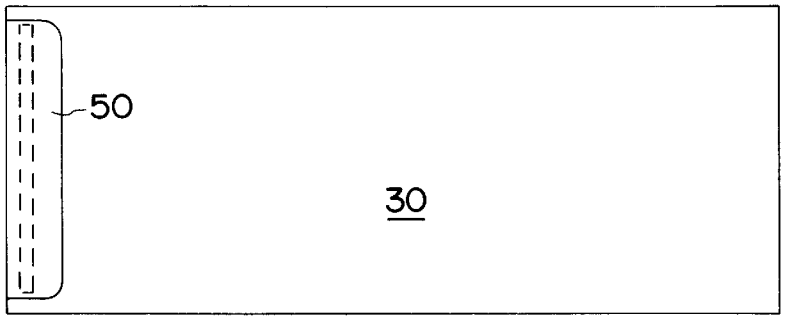
FIG. 7 is a top schematic view of the mattress tray usable with the FIG. 6 embodiment.
Figure 8:
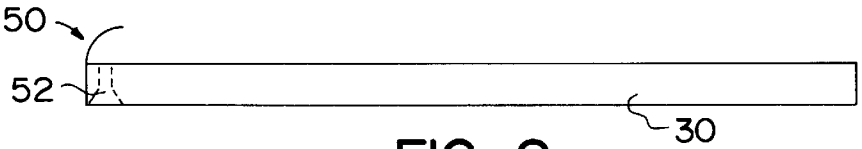
FIG. 8 is a side schematic view of the mattress tray of the present invention.

In FIG. 7, the mattress tray 30 is shown and which is normally affixed to the support arm 40 so that the mattress tray 30 moves with the support arm 40 as it pivots about the pivot point 42. An air deflector 50 is constructed with the mattress tray 30 and is curved upwardly as will be described. Turning briefly to FIG. 8, there is a passageway 52 formed in the mattress tray 30 and which is formed completely through the mattress tray 30 to provide a through opening that opens at the base of the air deflector 50. Again, the passageway 52 may be a plurality of small individual openings or may be an elongated slot formed in the mattress tray 30.

Figure 9:
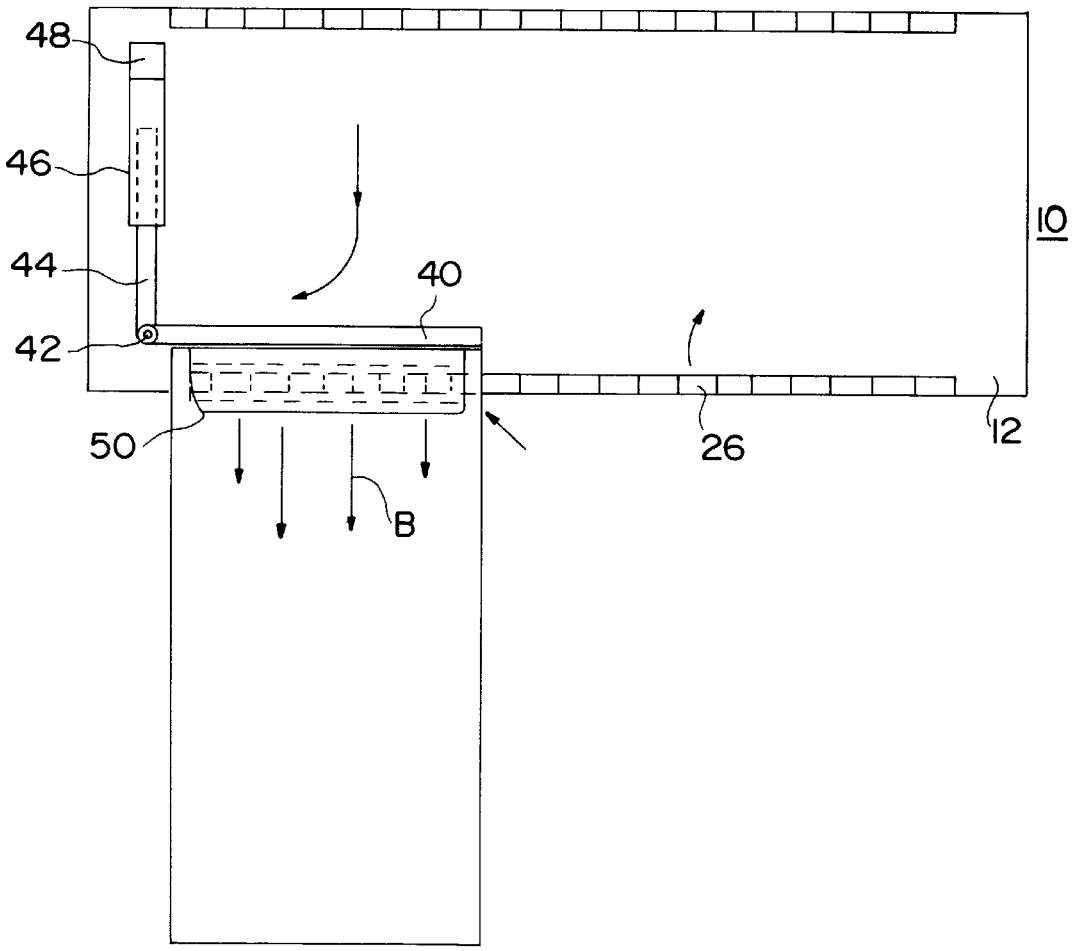
FIG. 9 is a top schematic view of the incubator embodiment of FIG. 6 showing the mattress tray in position outside the infant compartment.

Turning finally to FIG. 9, there is shown a schematic view of the incubator 10 showing the mattress tray 30 in its second position, that is, with the mattress tray 30 moved to a position where it is outside the infant compartment 14 so that the attending personnel can have the necessary access to the infant on all of three sides. As can be seen, the passageway 52 in the mattress tray 30 aligns with the air inlet 26 so that the warm air can pass through the mattress tray 30 and reach the air deflector 50 where the warm air is deflected so as to pass over an infant resting on the mattress tray 30 generally in the direction of the arrows B. The warm air thus warms an infant even when the mattress tray 30 has been moved to its second position where it is outside the infant compartment 14. Accordingly, with the embodiment of FIGS. 6–9, the mattress tray 30 can be rotated about 90 degrees and moved to a position with considerable access to an infant positioned thereon and yet the present invention provides a flow of heated air to warm the infant in such position.

While the invention has been disclosed and described with reference to a single embodiment, it will become apparent that variations and modifications may be made therein, and it is therefore intended in the following claims to cover each such variation and modification as falls within the true spirit and scope of the invention.

We claim:

1. An incubator for providing a controlled environment for an infant, said incubator having a base section and a hood mounted atop said base section to enclose an infant compartment therebetween for containing an infant, a heating and ducting means in said base section for providing a flow of warm air from said base section to said infant compartment, an air passageway for directing the warm air from said base section to said infant compartment, a mattress tray adapted to support an infant and having a first position enclosed within said infant compartment, said mattress tray being movable to a second position substantially outside of said infant compartment, said mattress tray having an inlet adapted to align with said air passageway when said mattress tray is moved from said first position to said second position to divert a portion of the flow of warm air from said air passageway through said mattress tray, said mattress tray further having a plurality of outlets adapted to channel said warm air to warm an infant supported on said mattress tray when said mattress tray is in said second position.

2. An incubator as defined in claim 1 wherein said plurality of outlets extends along the periphery of said mattress tray.

3. An incubator for providing a controlled environment for an infant, said incubator having a base section and a hood mounted atop said base section to enclose an infant compartment therebetween for containing an infant, a heating and ducting means in said base section for providing a flow of warm air from said base section to said infant compartment, an air passageway for directing the warm air from said base section to said infant compartment, a mattress tray adapted to support an infant being pivotably affixed to said base, said mattress tray having a first position enclosed within said infant compartment and pivotably movable about 90 degrees to a second position substantially outside of said infant compartment, said mattress tray adapted to receive a portion of the flow of warm air from said air passageway and channel said warm air to warm an infant supported on said mattress tray when said mattress tray is in said second position. second position.

4. An incubator as defined in claim 3, wherein said mattress tray has a inlet that receives the warm air from said air passageway after being pivoted 90 degrees to said second position.

5. An infant incubator for providing a heated atmosphere to an infant, said infant incubator comprising:

a base section, a hood mounted upon said base section, said hood adapted to form an infant compartment with said base, an access door in said hood, said access door being pivotally mounted to said base section and movable between a closed position enclosing an infant and an open position allowing access to an infant, heating and air ducting means in said base section for forcing heated air from said base section into said infant compartment at a predetermined temperature, an air inlet located along access door to allow the heated air to pass from said base section into said infant compartment, a mattress tray for supporting an infant, said mattress tray being movably positioned upon said base section between an first position wherein said mattress tray is enclosed within said infant compartment and a second position wherein said mattress tray is substantially removed from said infant compartment, said mattress tray further having an inlet passage and an outlet passage, air deflecting means activated when said mattress tray is moved from said first position to said second position to divert heated air passing through said air inlet to provide heated air to enter said inlet passage and pass through said mattress tray to said outlet passage to warm an infant when supported by said mattress tray in said second position of said mattress tray.

6. An infant incubator as defined in claim 5, wherein said inlet passageway aligns with said air inlets to receive the heated air therefrom.

7. An infant incubator as defined in claim 6, wherein said outlet passageway comprises a plurality of openings along the periphery of said mattress tray.

8. An infant incubator as defined in claim 7, wherein said plurality of openings are located substantially around the periphery of said mattress tray.

9. A method of maintaining the heated environment for an infant resting upon a mattress tray having a first position wherein said mattress tray is within an infant compartment of an incubator and having a second position wherein said mattress tray is substantially removed from said infant compartment, said method comprising:

moving the mattress tray supporting the infant from the first position to its second position, providing a heated flow of air to heat the infant compartment when said mattress tray is in said first position, and diverting a portion of said heated flow of air to heat the infant when said mattress tray is moved from said first position to said second position by passing said diverted air through said mattress tray.

10. An incubator for providing a controlled environment for an infant, said incubator having a base section and a hood mounted atop said base section to enclose an infant compartment therebetween for containing an infant, a heating and ducting means in said base section for providing a flow of warm air from said base section to said infant compartment, an air passageway for directing the warm air from said base section to said infant compartment, a mattress tray adapted to support an infant being pivotably affixed to said base, said mattress tray having a first position enclosed within said infant compartment and pivotably movable about 90 degrees to a second position substantially outside of said infant compartment, said mattress tray having an inlet adapted to receive a portion of the flow of warm air from said air passageway after being pivoted 90 degrees to said second position, said mattress tray further having a plurality of outlets to distribute the warm air from said inlet to the periphery of said mattress tray to channel said warm air to warm an infant supported on said mattress tray when said mattress tray is in said second position.

* * * * *